United States Patent [19]

Ishibashi et al.

[11] Patent Number: 4,898,600

[45] Date of Patent: Feb. 6, 1990

[54] APPARATUS FOR RECOVERING HIGH TEMPERATURE BLAST FURNACE GAS

[75] Inventors: Genichi Ishibashi; Hideyuki Kamano; Masahiko Seki, all of Chiba, Japan

[73] Assignee: Kawasaki Steel Corp., Japan

[21] Appl. No.: 224,487

[22] Filed: Jul. 26, 1988

[30] Foreign Application Priority Data

Jul. 31, 1987 [JP] Japan ..... 62-116599

[51] Int. Cl.[4] ..... B01D 53/14

[52] U.S. Cl. ..... 55/222; 55/223; 55/225; 55/258; 55/259

[58] Field of Search ..... 55/217, 222, 223, 225, 55/228, 258, 259

[56] References Cited

U.S. PATENT DOCUMENTS

| | | | |
|---|---|---|---|
| 1,022,496 | 4/1912 | Müller et al. | 55/259 X |
| 2,940,733 | 6/1960 | Umbricht | 55/222 X |
| 3,559,379 | 2/1971 | Lambert | 55/223 |
| 3,800,505 | 4/1974 | Tarves, Jr. | 55/228 X |
| 4,251,236 | 2/1981 | Fattinger et al. | 55/222 X |
| 4,530,822 | 7/1985 | Ashley et al. | 55/259 X |

FOREIGN PATENT DOCUMENTS

| | | | |
|---|---|---|---|
| 3531416 | 3/1987 | Fed. Rep. of Germany | 55/223 |
| 54-40207 | 3/1979 | Japan . | |
| 54-81107 | 6/1979 | Japan . | |
| 57-43913 | 3/1982 | Japan . | |
| 171031 | 11/1934 | Switzerland | 55/228 |

*Primary Examiner*—Robert Spitzer

*Attorney, Agent, or Firm*—Austin R. Miller

[57] ABSTRACT

A method and apparatus for recovering blast furnace gas for utilizing in a power plant such as an electric power generator employs a plurality of cooling arrangements. The cooling arrangements includes a first arrangement located upstream of a dust-removal equipment for controlling temperature of blast furnace gas to be about or below a critical temperature of the dust-removal equipment. The cooling arrangements also include a second arrangement located downstream of the dust-removal equipment and upstream of a power generator turbine for controlling gas temperature to be about or below a critical temperature of the turbine. The first and second arrangements are operative independently of each other in response to gas temperature.

30 Claims, 5 Drawing Sheets

APPARATUS FOR RECOVERING HIGH TEMPERATURE BLAST FURNACE GAS

BACKGROUND OF THE INVENTION

1. Field of the Invention

The present invention relates generally to a technique for recovering blast furnace gas. More particularly, the invention relates to a system for recovering blast furnace gas, which includes dry type dust removal equipment. Further particularly, the invention relates to a cooling system for the blast furnace gas.

2. Description of the Background Art

In the modern blast furnace, blast furnace gas is collected or recovered for utilizing in generation of electric power and so forth. In the blast furnace gas path, a dust removal equipment, such as bag filter, is provided for removing dust carried with the blast furnace gas. In recent years, dry type dust-removal equipments have been preferred because of higher temperature gas can be circulated to an electric power generation facility for better power generation performance.

Such blast furnace gas recovery system is effective for higher power generation performance in the normal operation state of the blast furnace, in which temperature of blast furnace gas is held stable at about 200° C. However, when channeling for forming direct path for furnace gas and whereby directly discharging higher temperature gas through top of the furnace, the blast furnace gas temperature rapidly rises to about 300° C. to about 400° C. and, in the worst case, to about 800° C. Such high temperature may cause damage in the dust-removal equipment, a turbine in a power generator, a septum valve and other component in the blast furnace gas recovery system. For preventing the components in the system from being damaged, the gas has to be cooled to lower the temperature in a level lower than critical temperature of respective components.

For example, Japanese Patent First (unexamined) Publication (Tokkai) Showa 54-40207, Japanese Patent First Publication (Tokkai) Showa 54-81107 and Japanese Patent First Publication (Tokkai) Showa 57-43913 propose cooling of gas by spraying water in dust catchers. These proposal is effective for lowering the gas temperature. However, in such case, the water spraying arrangement has to have a cooling capacity to satisfactorily lower the gas temperature even when channeling occurs. This increases cost for providing the water spraying arrangement. Since channeling of the furnace rarely occur and therefore, the aforementioned facility is only for emergency case, substantial cost increase is normally unacceptable.

On the other hand, the critical temperature of each component of the blast furnace gas recovery system is differentiated to others. For instance, the critical temperature of the bag filter as the dust-removal equipment is normally about 250° C., the critical temperature of the turbine is normally about 200° C., and the critical temperature of the septum valve is normally about 100° C. or lower. This means that the gas temperature at the bag filter is to be controlled at about 250° C. or lower and is not necessary to be lower than the critical temperature of the turbine and the septum valve.

SUMMARY OF THE INVENTION

Therefore, it is an object of the invention to provide a blast furnace gas recovery system which can effectively protect each component thereof from heat by controlling gas temperature at each component independently of others for achieving satisfactory cooling effect with maintaining cost for facility reasonably low.

In order to accomplish the aforementioned and other objects, a method and apparatus for recovering blast furnace gas for utilizing in a power plant such as an electric power generator, according to the invention, employs a plurality of cooling arrangements. The cooling arrangements include a first arrangement located upstream of a dust-removal equipment for controlling temperature of blast furnace gas to be about or below a critical temperature of the dust-removal equipment. The cooling arrangements also include a second arrangement located downstream of the dust-removal equipment and upstream of a power generator turbine for controlling gas temperature to be about or below a critical temperature of the turbine. The first and second arrangements are operative independently of each other in response to gas temperature.

According to one aspect of the invention, a blast furnace gas circulation system comprises a turbine driven by blast furnace gas for generating an electric power, the turbine having a turbine blade having a first heat resisting temperature, a gas flow passage connecting top of a blast furnace to the turbine, a dry type dust removing equipment disposed in the gas flow passage and designed for removing dust in the blast furnace gas, the equipment having a filter element having a second heat resisting temperature which is higher than the first heat resisting temperature, a first cooling equipment provided upstream of the dry type dust removing equipment for cooling the blast furnace gas to a temperature lower than the second heat resisting temperature, and a second cooling equipment provided downstream of the dry type dust removing equipment and upstream of the turbine, the second cooling equipment being responsive to the blast furnace gas temperature at upstream thereof higher than the first heat resisting temperature for cooling the blast furnace gas to the temperature lower than the first heat resisting temperature.

In the preferred construction, the blast furnace gas circulation system which further comprises a dust catcher provided in the gas flow passage upstream of the dry type dust removing equipment, and the first cooling equipment is disposed within the dust catcher. Furthermore, the blast furnace gas circulation system may further comprise a septum valve assembly provided in parallel to the turbine, and a third cooling equipment is provided downstream of the second cooling equipment and upstream of the septum valve assembly for cooling the blast furnace gas at a temperature below a third temperature.

The first cooling equipment may comprise a cooling water spray nozzle connected to a pressurized cooling water source via a supply line and a return line, the return line being connected to the supply line at a position upstream of the cooling water spray nozzle, a pressure regulating valve is disposed in the return passage for regulating a pressure of the cooling water supplied to the cooling water spray nozzle. The first cooling equipment has a plurality of cooling water spray nozzles including at least first and second nozzles, the first nozzle being connected to a first pressurized cooling water supply system including a first supply line and a first return line in which a first pressure regulator valve is disposed and the second nozzle being connected to a second pressurized cooling water supply system including a second supply line and a second return line in which a second pressure regulator valve being disposed.

The septum valve assembly comprises at least first and second septum valves and the third gas cooling equipment comprises a cooling water spray means variable of cooling water spray amount depending upon valve positions of the first and second septum valves. The third cooling equipment is associated with a gas temperature sensor detecting blast furnace gas temperature higher than the third temperature which is set at a temperature of heat resisting temperature of a component of the septum valves, so that it is enabled when the blast furnace gas temperature higher than the third temperature is detected.

On the other hand, the second cooling equipment may be associated with a gas temperature sensor monitoring blast gas temperature at a position downstream of the dry type dust removing equipment and upstream of the second cooling equipment and detective of the blast furnace gas temperature higher than the first temperature for enabling the second cooling equipment. The second cooling equipment can comprise a cooling water supply nozzle connected to a pressurized cooling water source via a supply line, in which a flow control valve responsive to the gas temperature sensor detecting the blast furnace gas temperature higher than the first temperature.

According to another aspect of the invention, a blast furnace gas circulation system comprises a turbine driven by blast furnace gas for generating an electric power, the turbine having a turbine blade having a first heat resisting temperature, a gas flow passage connecting top of a blast furnace to the turbine, a dry type dust removing equipment disposed in the gas flow passage and designed for removing dust in the blast furnace gas, the equipment having a filter element having a second heat resisting temperature which is higher than the first heat resisting temperature, a septum valve provided in parallel to the turbine, which septum valve having third heat resisting temperature, a first cooling equipment provided upstream of the dry type dust removing equipment for cooling the blast furnace gas to a temperature lower than the second heat resisting temperature, a second cooling equipment provided downstream of the dry type dust removing equipment and upstream of the turbine, the second cooling equipment being responsive to the blast furnace gas temperature at upstream thereof higher than the first heat resisting temperature for cooling the blast furnace gas to the temperature lower than the first heat resisting temperature, and a third cooling equipment, provided upstream of the septum valve and responsive to the blast furnace gas temperature higher than the third heat resisting temperature for cooling the blast furnace gas to the temperature lower than the third heat resisting temperature.

According to a further aspect of the invention, a blast furnace gas circulation system comprises a turbine driven by blast furnace gas for generating an electric power, the turbine having a turbine blade having a first heat resisting temperature, a gas flow passage connecting top of a blast furnace to the turbine, a dry type dust removing equipment disposed in the gas flow passage and designed for removing dust in the blast furnace gas, the equipment having a filter element having a second heat resisting temperature which is higher than the first heat resisting temperature, a septum valve provided in parallel to the turbine, which septum valve having third heat resisting temperature, a gas recirculating circuit provided for recirculating part of the blast furnace gas to a charge system of the blast furnace, a first cooling equipment provided upstream of the dry type dust removing equipment for cooling the blast furnace gas to a temperature lower than the second heat resisting temperature, a second cooling equipment provided downstream of the dry type dust removing equipment and upstream of the turbine, the second cooling equipment being responsive to the blast furnace gas temperature at upstream thereof higher than the first heat resisting temperature for cooling the blast furnace gas to the temperature lower than the first heat resisting temperature, a third cooling equipment, provided upstream of the septum valve and responsive to the blast furnace gas temperature higher than the third heat resisting temperature for cooling the blast furnace gas to the temperature lower than the third heat resisting temperature, and a fourth cooling equipment disposed within the gas recirculation circuit and responsive to the temperature of the blast furnace gas recirculating in the gas recirculation circuit higher than a fourth temperature for cooling the blast furnace gas to the temperature lower than the fourth temperature.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
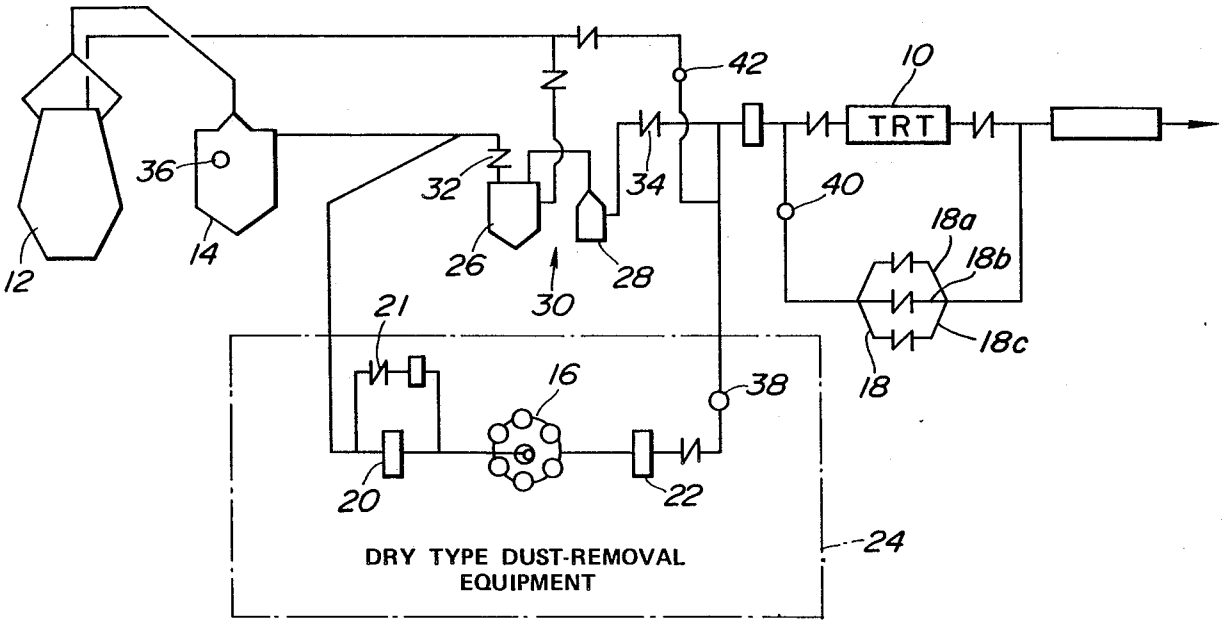
FIG. 1 is an explanatory and schematically illustrated diagram of the preferred embodiment of a blast furnace gas flow circuit including a dust-removing system, a turbine generator and so forth, according to the present invention.

Referring now to the drawings, particularly to FIG. 1, the preferred embodiment of a blast gas flow circuit system, according to the present invention, includes a top pressure recovery turbine 10 for generating an electric power utilizing blast furnace gas. The top pressure recovery turbine 10 is connected to the top of a blast furnace 12 via a dust catcher 14, a bag filter 16. The bag filter 16 employed in the shown embodiment of the blast furnace gas flow circuit system is a dry type bag filter. A septum valve 18 is provided in parallel to the top pressure recovery turbine 10.

Ball valves 20 and 22 are provided at both upstream and downstream of the bag filter 16. The bag filter 16 and the ball valves 20 and 22 form a dry type dust-removal equipment 24 in the gas flow circuit. In parallel to the upstream side ball valve 20, is a filling pressure butterfly valve 21.

A ring slit washer 26 and a mist separator 28 forming a wet-type dust-removal equipment 30 is also installed in the shown embodiment of the blast gas flow circuit system in parallel relationship with the dry type dust-removal equipment 24. Butterfly valves 32 and 34 are provided at both upstream of the ring slit washer 26 and downstream of the mist separator 28.

Figure 3:
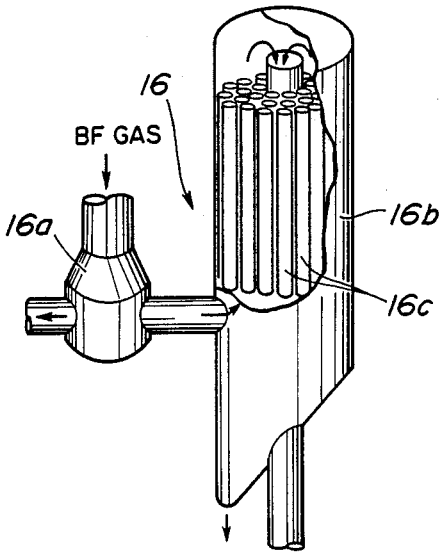
FIG. 3 is an illustration of a bag filter employed in the preferred embodiment of a blast furnace gas flow circuit of FIG. 1.

Here, in order to maintain the dry type bag filter 16 shown in FIG. 3, which comprises a raw gas chamber **16*a* and a bag chamber 16*b* disposed therein a plurality of cylindrical resin filter elements 16*c* whose heat resistantive temperature is lower than or equal to 250° C. Therefore, in order to prevent the filter elements 16*c* from melting down due to excessive blast furnace gas temperature, the blast gas temperature to be introduced into the bag filter is to be maintained lower than 200° C. and preferably in a range of 200° C. to 180° C. On the other hand, in order to protect the turbine blade of the top pressure recovery turbine 10 from damaging by heat, the blast gas temperature has to be maintained below 200° C. Furthermore, in case of the blast furnace gas is shut off from the top pressure recovery turbine 10 in certain reason, such as in case of maintenance, the blast furnace gas temperature to flow through the septum valve 18 has to be lower than 100° C. On the other hand, in the normal of the blast furnace operation, the blast furnace gas at the top of the blast furnace 12 is usual at a temperature of 150° C. to 200° C. Therefore, as long as the blast furnace operates in normal condition, the blast furnace gas temperature in the normal temperature range, i.e. 200° C. to 180° C., will not affect to the dry type bag filter 16 and the top pressure recovery turbine 10. However, the blast furnace gas at the top of the blast furnace 12 tends to fluctuate in significant level depending upon the operating condition of the furnace, so that the blast furnace gas temperature at the top of the blast furnace 12 becomes higher than the upper temperature limit, e.g. 250° C. of the bag filter 16**. In the significant case, such as at the occurrence of channeling, the blast furnace gas temperature is inclined to become higher than 1000° C. In such case, the blast furnace gas has to be effectively cooled so as not to damage the components of the blast furnace gas flow circuit.

In order to accomplish satisfactory protection of the components of the blast furnace gas flow circuit without causing substantial increase of the cost and degradation of the electric power generating efficiency at the top pressure recovery turbine 10, gas cooling equipments 36, 38, 40 and 42 are provided in the circuit. The gas cooling equipment 36 is disposed in the dust catcher 14. The gas cooling equipment 38 is disposed in the gas flow piping downstream of the bag filter 16. The gas cooling equipment 40 is provided at an orientation upstream of the septum valve. The gas cooling equipment 42 is provided in a return piping recirculating the gas to a charge system of the blast furnace 12.

Figure 2:
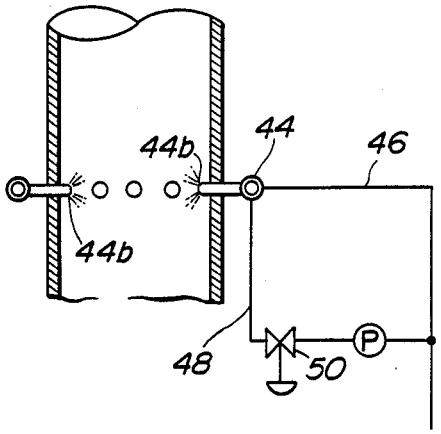
FIG. 2 is an explanatory illustration of a cooling water spray nozzle and an associated cooling water supply circuit, which is associated with a dust catcher in the circuit of FIG. 1.
Figure 8:
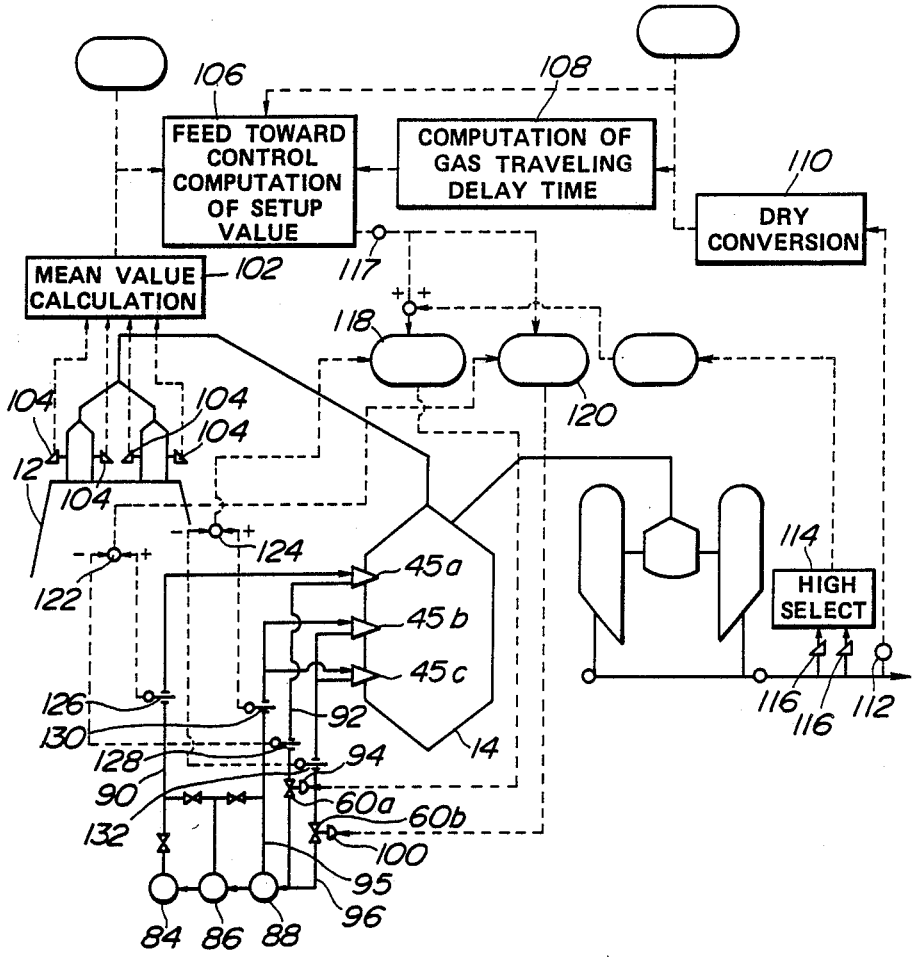
FIG. 8 is a diagram showing a gas cooling system for cooling gas introduced into a dust catcher.

As shown in FIG. 2, the gas cooling equipment 36 comprises a ring shaped water spray nozzle 44 disposed in the dust catcher 14. The water spray nozzle 44 is connected to a cooling water supply system including a cooling spray supply line 46 and a return line 48. The return line 48 is connected to the supply line 46 at the position upstream of the cooling water spray nozzle 44 and also upstream of a pump 47 which pressurizes the cooling water. A flow control valve 50 is provided in the return line 48 for adjusting the cooling water pressure circulating in the cooling water supply system via the cooling water spray nozzle 44 and whereby adjust the amount of cooling water to be discharged through the cooling water spray nozzle. The shown cooling water supply circuit is advantageously introduced for precisely adjusting the blast furnace gas temperature in the dust catcher 14. In order to facilitate precise gas temperature control, the gas cooling equipment 36 is associated with a dust catcher gas cooling control system which is shown in FIG. 8 and will be discussed later.

Figure 4:
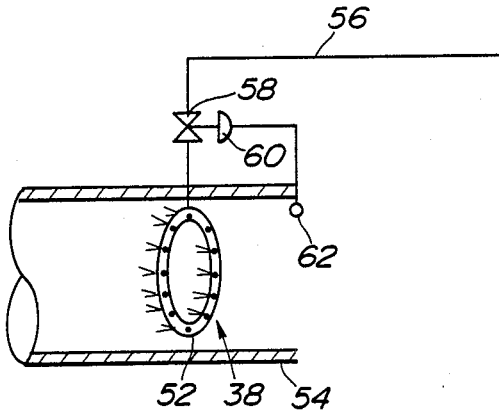
FIG. 4 is an explanatory illustration of a cooling water spray nozzle and an associated cooling water supply circuit, employed in a gas flow piping such as downstream of the bag filter in the circuit of FIG. 1.

As shown in FIG. 4, the gas cooling equipment 38 comprises a ring shaped cooling water spray nozzle 52 is disposed within a gas flow pipe 54 connecting the bag filter 16 to the top pressure recovery turbine 10. The cooling water spray nozzle 52 is connected to a cooling water supply system having a cooling water supply line 56 and a cooling water flow control valve 58 disposed in the supply line. The cooling water flow control valve 58 is associated with a valve actuator 60 which is connected to a temperature sensor 62 disposed in the gas flow pipe 54. The temperature sensor 62 is designed to vary sensor signal level between HIGH and LOW levels depending upon the blast gas temperature in relation to a set temperature. Namely, when the blast gas temperature rises across the set temperature, the sensor signal level changes from LOW level to HIGH level to energize the valve actuator 60 to open the flow control valve 58. As will be appreciated, since blast furnace gas to be introduced into the turbine of the top pressure recovery turbine 10 is to be maintained approximately at 200° C. to 180° C., the set temperature will be set in this range so that the gas cooling equipment 38 is active when the blast furnace gas flowing the gas flow pipe 54 is higher than 200° C.

Since the gas cooling equipment 38 is not required high precision in adjusting the blast furnace gas temperature as that required for the gas cooling equipment 36, the simple construction as set forth above would be satisfactory for achieving the desired gas cooling effect.

It should be noted that the gas cooling equipment 42 in the return line is of the same construction as to the gas cooling equipment 38 forth above.

Figure 5:
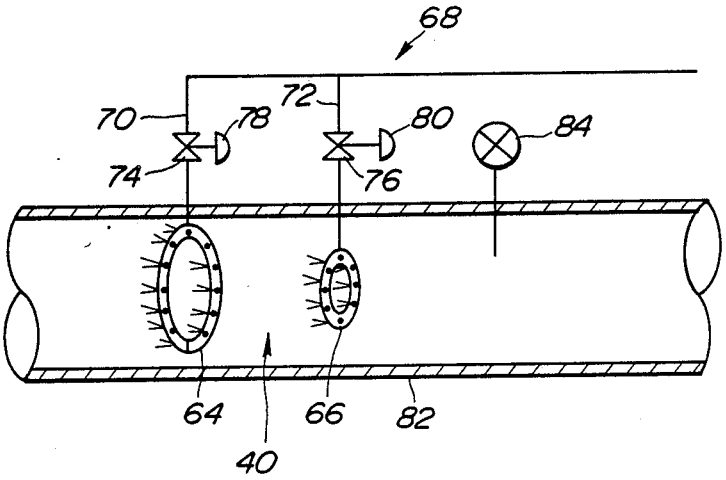
FIG. 5 is an explanatory illustration of a cooling water spray nozzle and an associated cooling water supply circuit, employed in a gas flow piping such as upstream of a septum valve in the circuit of FIG. 1.
Figure 9:
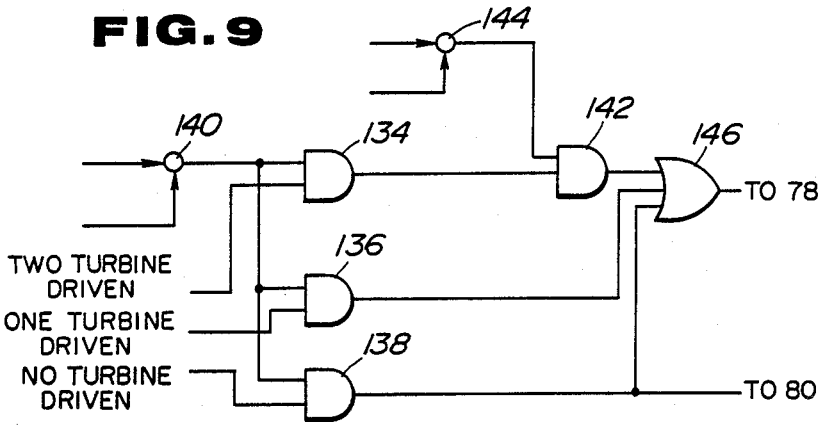
FIG. 9 is a circuit diagram showing control system for the water supply for the water spray nozzle of FIG. 5.

FIG. 5 shows construction of the gas cooling equipment 40 for cooling the blast furnace gas to be introduced into the septum valve 18. The gas cooling equipment 40 comprises a pair of a larger diameter cooling water spray nozzle 64 and a smaller diameter cooling water spray nozzle 66. The cooling water spray nozzles 64 and 66 are connected to a cooling water supply circuit 68 including branch lines 70 and 72 respectively connected thereto. Flow control valves 74 and 76 are disposed in the branch lines 70 and 72 for controlling water supply to respectively associated cooling water spray nozzles 64 and 66. The flow control valves 70 and 72 are associated with valve actuators 78 and 80. The valve actuators 78 and 80 are selectively operated for controlling cooling water supply depending upon the blast furnace gas temperature flowing through the gas flow passage 82 for the septum valve 18 as monitored by means of a gas temperature sensor 84, and depending upon the valve condition of the septum valve 18. Namely, in the shown embodiment, the septum valve 18 has three valve elements 18*a*, 18*b* and 18*c* which are selectively open and close depending upon the operating condition of the top pressure recovery turbine 10. In order to control the flow control valves 74 and 76 in synchronism with selection of the valve elements 18*a*, 18*b* and 18*c* and in order to adjust cooling efficiency, the valve actuators 78 and 80 are connected to an electric water spray control system which is illustrated in FIG. 9 and will be discussed later.

Figure 6:
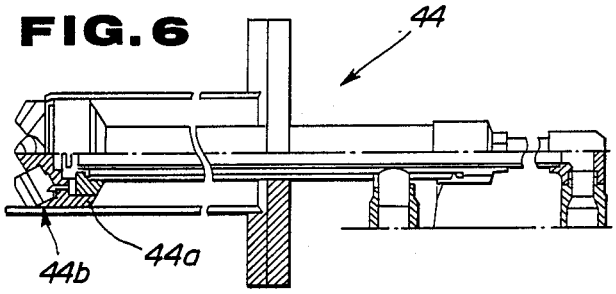
FIG. 6 is a section showing detail of the water spray nozzle of FIG. 2.
Figure 7:
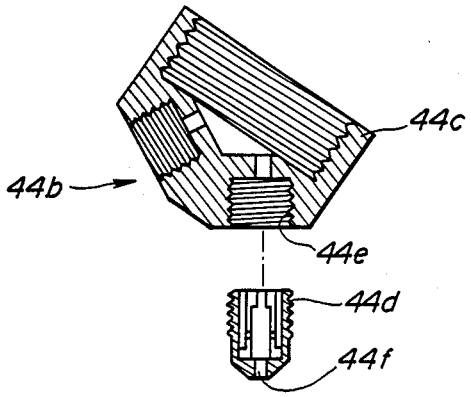
FIG. 7 is an enlarged section showing a detailed construction of a spray nozzle element of the water spray nozzle of FIG. 6.

As seen from FIGS. 6 and 7, the ring shaped cooling water spray nozzle 44 comprises a ring shaped spray body 44*a*, on which a discharge nozzle assembly 44*b* is arranged for discharging or spraying substantially small particle cooling water. The discharge nozzle assembly 44*b* comprises a nozzle base 44*c* fixedly threaded to the spray body 44*a* and nozzle head 44*d* fixedly threaded to the nozzle base 44*c*. Each nozzle base 44*c* is formed with a plurality of and circumferentially arranged nozzle head receptacles 44*e* to which the nozzle heads 44*d* are secured. Each nozzle head 44*d* has discharged orifice 44*f* to spray substantially high pressure and small particle size of cooling water therethrough.

FIG. 8 shows the gas cooling control system provided to control cooling water spray amount to be discharged through the gas cooling equipment 36 in the dust catcher 14. In order to facilitate precise blast furnace gas temperature control with satisfactorily high response, the shown gas cooling control system takes feed forward technologies for adjusting the set pressure in the flow control valve 50. As particularly illustrated in FIG. 8, the shown embodiment employs three cooling water spray nozzles 45*a*, 45*b* and 45*c* disposed in the dust catcher 14 in vertical alignment to each other. In the shown embodiment, the uppermost spray nozzle 45*a* has 35 nozzle heads for discharging cooling water, the lowermost spray nozzle 45*c* has 17 nozzle heads and the intermediate spray nozzle 45*b* has 18 nozzle heads. A cooling water supply system has three water pumps 84, 86 and 88 arranged in tandem fashion. The pressurized cooling water flows through the pumps in order of 88, 86 and 84. The outlet of the pump 84 is connected to the cooling water spray nozzle 45*a* via a supply line 90. The spray 45*a* is also connected to the inlet of the pump 88 via a return line 92, in which the flow control valve 60*a* is provided. The pressure regulation valve 60*a* is associated with a valve actuator 94. The pump 88 has two discharge outlets. One of the outlets is connected to the pump 86. On the other hand, the other of the outlets is commonly connected to the spray nozzles 45*b* and 45*c* via line 95. The spray nozzles 45*b* and 45*c* are also connected to the inlet of the pump 88 through a return line 96 via a pressure regulation valve 60*b*. The pressure control valve 60*b* is associated with valve actuator 100.

The valve actuators 94 and 100 are connected to an electric or electronic gas cooling control system which are illustrated in a form of functional diagram showing operations to be performed by the control system. The control system includes mean value calculation stage 102 which receives furnace gas temperature sensor signal from temperature sensors 104 to produce a gas temperature indicative data in indicative of the blast furnace gas temperature at the top of the blast furnace 12, which gas temperature indicative data will be hereafter referred to as "top gas temperature data". The top gas temperature data is fed to a feed forward control computation stage 106, in which a cooling water amount to be discharged through the cooling water spray nozzles 45*a*, 45*b* and 45*c* is determined.

The feed forward control computation stage 106 is associated with a gas traveling delay computation stage 108 which is, in turn, associated with a dry conversion stage 110 in which gas flow delay factor is derived on the basis of a blast furnace gas flow rate data obtained by means of a gas flow meter 112 provided in the vicinity of the bag filter 16. The feed forward control computation stage 106 is associated with a feedback gas temperature data derivation stage 114 which is labeled as "high select" and receives blast furnace gas temperature sensor signals from temperature sensors 116 to select higher temperature indicative gas temperature sensor signal as the feedback gas temperature data. Furthermore, the feed forward control computation stage 106 directly associated with the dry conversion stage 110 to receive therefrom a gas flow amount indicative data.

In the feed forward control computation stage 106, arithmetic operation with taking the top gas temperature data, the gas flow delay factor, the feedback gas temperature data and the gas flow amount data for deriving the cooling water discharge amount. Distribution of the derived cooling water discharge amount to be discharged through the spray nozzles 45*a*, 45*b* and 45*c* is determined by a discharge distribution deriving stage 117. In the discharge distribution deriving stage 117, discharge control signals for the valve actuators 94 and 100 are generated and fed to the latter via flow control IC circuits (FIC) 118 and 120. The flow control IC circuits 118 and 120 are connected to subtractors 122 and 124 respectively. The subtractor 122 is connected to cooling water pressure sensors 126 and 128 to produce a water pressure difference indicate data. Similarly, the subtractor 124 is connected to cooling water pressure sensors 130 and 132 to produce a water pressure difference indicate data. These pressure difference indicative data are fed to the flow control IC circuits 118 and 120 as feedback data so that the operation magnitude of the valve actuators 94 and 100 are controlled based thereon.

In the practical data of the cooling water spray nozzles 45*a*, 45*b* and 45*c* are illustrated as follow:

DISCHARGE START CONDITION

Spray Nozzle 45*a*

When top gas temperature reaches 400° C. or when cooling water rate to be distributed to the nozzles 45*b* and 45*c* becomes greater than or equal to 80 $m^3$/H.

Spray Nozzle 45*b*

When the cooling water flow rate to be distributed to the nozzles 45*c* becomes greater than or equal to 30 $m^3$/H.

Spray Nozzle 45*c*

When top gas temperature reaches 250° C. or when the feedback gas temperature is 190° C.

DISCHARGE TERMINATING CONDITION

Spray Nozzle 45*a*

When top gas temperature reaches 370° C. or when cooling water rate to be distributed to the nozzles 45b and 45c becomes greater than or equal to 70 $m^3/H$.

Spray Nozzle 45b

When the cooling water flow rate to be distributed to the nozzles 45b and 45c becomes less than or equal to 20 $m^3/H$.

Spray Nozzle 45c

When top gas temperature reaches 240° C. or when the feedback gas temperature is 170° C.

MINIMUM DISCHARGE AMOUNT

Spray Nozzle 45a: 60 $m^3/H$
Spray Nozzle 45b: 10 $m^3/H$
Spray Nozzle 45c: 4 $m^3/H$

MAXIMUM DISCHARGE AMOUNT

Spray Nozzle 45a: 253 $m^3/H$
Spray Nozzle 45b+45c: 131 $m^3/H$

AVERAGE SPRAYED WATER PARTICLE SIZE

Spray Nozzle 45a: 120 micrometer
Spray Nozzle 45b+45c: 96 micrometer

The above-examplified data is set in the feed forward control computation stage 106 to be utilized for deriving the cooling water discharge amount.

FIG. 9 shows control circuit for controlling the cooling water delivery for the cooling water spray nozzles 64 and 66. The control circuit includes three AND gates 134, 136 and 138. One input of the AND gate 134 is connected to a gas temperature dependent signal generator element 140 which is designed to reverse output signal to produce HIGH level signal in response to the gas temperature as monitored by the gas temperature sensor 84 higher than a preset water discharge criterion and reverse output signal to produce LOW level signal in response to the gas temperature lower than a preset water discharge termination criterion. The gas temperature dependent signal generator element 140 is also connected to one input terminal of the AND gate 136 and 138. To the other input terminal of the AND gate 134, HIGH level signal is input when two turbines are in operation. To the other input terminal of the AND gate 136, HIGH level signal is input when single turbine is in operation. On the other hand, when none of the turbine is driven, HIGH level signal is input to the AND gate 138.

The output terminal of the AND gate 134 is connected to one input terminals of another AND gate 142. The other AND gate 142 is connected to a flip-flop 144 which is set when value open rate of the septum valve becomes greater than or equal to 10% and is reset when valve open rate becomes smaller than or equal to 5%. The output terminals of the AND gates 142, 136 and 138 are connected to an OR gate 146. The output terminal of the OR gate is connected to the valve actuator 78. The output terminal of the AND gate 138 is connected to the valve actuator 80.

By the control circuit set forth above, the cooling water can be selectively supplied to the cooling water spray nozzles depending upon the operating condition of the top pressure recovery turbine 10 and depending upon the gas temperature.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A blast furnace gas circulation system comprising:

a turbine driven by blast furnace gas for generating an electric power, said turbine having a turbine blade having a first heat resisting temperature;

a gas flow passage connecting top of a blast furnace to said turbine;

a dry type dust removing equipment disposed in said gas flow passage and designed for removing dust in said blast furnace gas, said equipment having a filter element having a second heat resisting temperature which is higher than said first heat resisting temperature;

a first cooling equipment provided upstream of said dry type dust removing equipment for cooling said blast furnace gas to a temperature lower than said second heat resisting temperature; and a second cooling equipment provided downstream of said dry type dust removing equipment and upstream of said turbine, said second cooling equipment being responsive to said blast furnace gas temperature at upstream thereof higher than said first heat resisting temperature for cooling said blast furnace gas to the temperature lower than said first heat resisting temperature.

2. A blast furnace gas circulation system as set forth in claim 1, which further comprises a dust catcher provided in said gas flow passage upstream of said dry type dust removing equipment, and said first cooling equipment is disposed within said dust catcher.

3. A blast furnace gas circulation system as set forth in claim 2, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

4. A blast furnace gas circulation system as set forth in claim 3, said first cooling equipment has a plurality of cooling water spray nozzles including at least first and second nozzles, said first nozzle being connected to a first pressurized cooling water supply system including a first supply line and a first return line in which a first pressure regulator valve is disposed and said second nozzle being connected to a second pressurized cooling water supply system including a second supply line and a second return line in which a second pressure regulator valve being disposed.

5. A blast furnace gas circulation system as set forth in claim 1, which further comprises a septum valve assembly provided in parallel to said turbine, and a third cooling equipment is provided downstream of said second cooling equipment and upstream of said septum valve assembly for cooling the blast furnace gas at a temperature below a third temperature.

6. A blast furnace gas circulation system as set forth in claim 5, wherein said septum valve assembly comprises at least first and second septum valves and said third gas cooling equipment comprises a cooling water spray means variable of cooling water spray amount depending upon valve positions of said first and second septum valves.

7. A blast furnace gas circulation system as set forth in claim 6, wherein said third cooling equipment is associated with a gas temperature sensor detecting blast furnace gas temperature higher than said third temperature which is set at a temperature of heat resisting temperature of a components of said septum valves, so that it is enabled when said blast furnace gas temperature higher than said third temperature is detected.

8. A blast furnace gas circulation system as set forth in claim 1, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

9. A blast furnace gas circulation system as set forth in claim 1, wherein said second cooling equipment is associated with a gas temperature sensor monitoring blast gas temperature at a position downstream of said dry type dust removing equipment and upstream of said second cooling equipment and detective of the blast furnace gas temperature higher than said first temperature for enabling said second cooling equipment.

10. A blast furnace gas circulation system as set forth in claim 9, wherein said second cooling equipment comprises a cooling water supply nozzle connected to a pressurized cooling water source via a supply line, in which a flow control valve responsive to said gas temperature sensor detecting said blast furnace gas temperature higher than said first temperature.

11. A blast furnace gas circulation system as set forth in claim 1, which further comprises a circuit for recirculating part of blast furnace gas to a charge system of the blast furnace, and a third cooling equipment responsive to a blast furnace gas temperature higher than a third temperature for cooling said blast furnace gas to the temperature lower than said third temperature.

12. A blast furnace gas circulation system as set forth in claim 11, which further comprises a circuit for recirculating part of blast furnace gas to a charge system of the blast furnace, and a fourth cooling equipment responsive to a blast furnace gas temperature higher than a fourth temperature for cooling said blast furnace gas to the temperature lower than said fourth temperature.

13. A blast furnace gas circulation system comprising:

a turbine driven by blast furnace gas for generating an electric power, said turbine having a turbine blade having a first heat resisting temperature;

a gas flow passage connecting top of a blast furnace to said turbine;

a dry type dust removing equipment disposed in said gas flow passage and designed for removing dust in said blast furnace gas, said equipment having a filter element having a second heat resisting temperature which is higher than said first heat resisting temperature;

a septum valve provided in parallel to said turbine, which septum valve having third heat resisting temperature;

a first cooling equipment provided upstream of said dry type dust removing equipment for cooling said blast furnace gas to a temperature lower than said second heat resisting temperature;

a second cooling equipment provided downstream of said dry type dust removing equipment and upstream of said turbine, said second cooling equipment being responsive to said blast furnace gas temperature at upstream thereof higher than said first heat resisting temperature for cooling said blast furnace gas to the temperature lower than said first heat resisting temperature; and a third cooling equipment, provided upstream of said septum valve and responsive to said blast furnace gas temperature higher than said third heat resisting temperature for cooling the blast furnace gas to the temperature lower than said third heat resisting temperature.

14. A blast furnace gas circulation system as set forth in claim 13, which further comprises a dust catcher provided in said gas flow passage upstream of said dry type dust removing equipment, and said first cooling equipment is disposed within said dust catcher.

15. A blast furnace gas circulation system as set forth in claim 14, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

16. A blast furnace gas circulation system as set forth in claim 15, said first cooling equipment has a plurality of cooling water spray nozzles including at least first and second nozzles, said first nozzle being connected to a first pressurized cooling water supply system including a first supply line and a first return line in which a first pressure regulator valve is disposed and said second nozzle being connected to a second pressurized cooling water supply system including a second supply line and a second return line in which a second pressure regulator valve being disposed.

17. A blast furnace gas circulation system as set forth in claim 13, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

18. A blast furnace gas circulation system as set forth in claim 13, wherein said septum valve assembly comprises at least first and second septum valves and said third gas cooling equipment comprises a cooling water spray means variable of cooling water spray amount depending upon valve positions of said first and second septum valves.

19. A blast furnace gas circulation system as set forth in claim 18, wherein said third cooling equipment is associated with a gas temperature sensor detecting blast furnace gas temperature higher than said third temperature which is set at a temperature of heat resisting temperature of a components of said septum valves, so that it is enabled when said blast furnace gas temperature higher than said third temperature is detected.

20. A blast furnace gas circulation system as set forth in claim 13, wherein said second cooling equipment is associated with a gas temperature sensor monitoring blast gas temperature at a position downstream of said dry type dust removing equipment and upstream of said second cooling equipment and detective of the blast furnace gas temperature higher than said first temperature for enabling said second cooling equipment.

21. A blat furnace gas circulation system as set forth in claim 20, wherein said second cooling equipment comprises a cooling water supply nozzle connected to a pressurized cooling water source via a supply line, in which a flow control valve responsive to said gas temperature sensor detecting said blast furnace gas.

22. A blast furnace gas circulation system comprising:

a turbine driven by blast furnace gas for generating an electric power, said turbine having a turbine blade having a first heat resisting temperature;

a gas flow passage connecting top of a blast furnace to said turbine;

a dry type dust removing equipment disposed in said gas flow passage and designed for removing dust in said blast furnace gas, said equipment having a filter element having a second heat resisting temperature which is higher than said first heat resisting temperature;

a septum valve provided in parallel to said turbine, which septum valve having third heat resisting temperature;

a gas recirculating circuit provided for recirculating part of said blast furnace gas to a charge system of said blast furnace;

a first cooling equipment provided upstream of said dry type dust removing equipment for cooling said blast furnace gas to a temperature lower than said second heat resisting temperature;

a second cooling equipment provided downstream of said dry type dust removing equipment and upstream of said turbine, said second cooling equipment being responsive to said blast furnace gas temperature at upstream thereof higher than said first heat resisting temperature for cooling said blast furnace gas to the temperature lower than said first heat resisting temperature;

a third cooling equipment, provided upstream of said septum valve and responsive to said blast furnace gas temperature higher than said third heat resisting temperature for cooling the blast furnace gas to the temperature lower than said third heat resisting temperature; and a fourth cooling equipment disposed within said gas recirculation circuit and responsive to the temperature of said blast furnace gas recirculating in said gas recirculation circuit higher than a fourth temperature for cooling the blast furnace gas to the temperature lower than said fourth temperature.

23. A blast furnace gas circulation system as set forth in claim 22, which further comprises a dust catcher provided in said gas flow passage upstream of said dry type dust removing equipment, and said first cooling equipment is disposed within said dust catcher.

24. A blast furnace gas circulation system as set forth in claim 23, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

25. A blast furnace gas circulation system as set forth in claim 24, said first cooling equipment has a plurality of cooling water spray nozzles including at least first and second nozzles, said first nozzle being connected to a first pressurized cooling water supply system including a first supply line and a first return line in which a first pressure regulator valve is disposed and said second nozzle being connected to a second pressurized cooling water supply system including a second supply line and a second return line in which a second pressure regulator valve being disposed.

26. A blast furnace gas circulation system as set forth in claim 22, wherein said first cooling equipment comprises a cooling water spray nozzle connected to a pressurized cooling water source via a supply line and a return line, said return line being connected to said supply line at a position upstream of said cooling water spray nozzle, a flow control valve is disposed in said return passage for regulating a pressure of said cooling water supplied to said cooling water spray nozzle.

27. A blast furnace gas circulation system as set forth in claim 22, wherein said septum valve assembly comprises at least first and second septum valves and said third gas cooling equipment comprises a cooling water spray means variable of cooling water spray amount depending upon valve positions of said first and second septum valves.

28. A blast furnace gas circulation system as set forth in claim 27, wherein said third cooling equipment is associated with a gas temperature sensor detecting blast furnace gas temperature higher than said third temperature which is set at a temperature of heat resisting temperature of a components of said septum valves, so that it is enabled when said blast furnace gas temperature higher than said third temperature is detected.

29. A blast furnace gas circulation system as set forth in claim 22, wherein said second cooling equipment is associated with a gas temperature sensor monitoring blast gas temperature at a position downstream of said dry type dust removing equipment and upstream of said second cooling equipment and detective of the blast furnace gas temperature higher than said first temperature for enabling said second cooling equipment.

30. A blast furnace gas circulation system as set forth in claim 29, wherein said second cooling equipment comprises a cooling water supply nozzle connected to a pressurized cooling water source via a supply line, in which a flow control valve responsive to said gas temperature sensor detecting said blast furnace gas.

* * * * *